US006179661B1

(12) United States Patent
Chiou

(10) Patent No.: US 6,179,661 B1
(45) Date of Patent: Jan. 30, 2001

(54) ELECTRICAL CONNECTOR WITH A SECURELY ATTACHED SHIELD

(75) Inventor: Song-Rong Chiou, Lin-Kou (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/307,957

(22) Filed: May 10, 1999

(30) Foreign Application Priority Data

Aug. 27, 1998 (TW) ..... 87214069

(51) Int. Cl.[7] ..... H01R 13/648; H01R 9/03
(52) U.S. Cl. ..... 439/607; 439/610
(58) Field of Search ..... 439/607, 610, 439/609, 675, 901, 885, 424

(56) References Cited

U.S. PATENT DOCUMENTS 4,722,022 * 1/1988 Myers et al. ..... 361/424
5,326,281 * 7/1994 Yin ..... 439/607
5,975,954 * 11/1999 Wu et al. ..... 439/607

* cited by examiner

*Primary Examiner*—Brian Sircus
*Assistant Examiner*—Chandrika Prasad
(74) *Attorney, Agent, or Firm*—Wei Te Chung

(57) ABSTRACT

An electrical connector comprises an insulative housing having two side faces respectively defining a guiding channel therein along a longitudinal direction thereof. A front face is connected to the side faces. A rear face is opposite to the front face and also connected to the side faces. The rear face has two ends extending beyond the side faces and respectively defining a slot therein. A top face is connected to the side faces, the front face, and the rear face. A metallic shielding has two side faces, a front face, and a top face for respectively attaching to the side faces, the front face, and the top face of the housing. Two rear tabs respectively extend from the side faces of the shielding for engaging within the slots of the rear face of the housing.

15 Claims, 8 Drawing Sheets

ELECTRICAL CONNECTOR WITH A SECURELY ATTACHED SHIELD

BACKGROUND OF THE INVENTION

1. Field of The Invention

The present invention relates to an electrical connector, and particularly to an electrical connector having a well shielding structure for configuring to an insulative housing thereof with satisfactory retention.

2. The Prior Art

Advanced electrical connectors, particularly high frequency electrical connectors, such as IEEE 1394 connectors, are covered with a corresponding shielding for suppression of noise during signal transmission. Some related patents are Taiwan Patents Nos. 85216816, 85212192. Although these connectors as disclosed have a shielding structure for suppression of noise. However, the configuration between the shielding structure and the insulative housing is not stable thus causing unwanted loose engagement therebetween. Additionally, the complication of the shielding structure usually raises manufacturing cost.

SUMMARY OF THE INVENTION

The primary purpose of the present invention is to provide an improved electrical connector which can provide a relatively good positioning effect between the shielding structure and the insulative housing thereof thus preventing loose engagement therebetween.

Another purpose of the present invention is to provide an improved electrical connector having a good shielding effect for suppression of noise.

A further purpose of the present invention is to provide an improved electrical connector having a simple shielding structure easily configured to an insulative housing thereof.

In accordance with one aspect of the present invention, an electrical connector comprising an insulative housing having a first side face defining a first guiding channel therein along a longitudinal direction thereof, a second side face defining a second guiding channel therein along a longitudinal direction thereof, a front face connected to the first side face and the second side face, a rear face opposite the front face and connected to the first side face and the second side face, and a top face connected to the first side face, the second side face, the front face, and the rear face. The rear face has two ends respectively extending beyond the first side face and the second side face and each end defines a slot therein communicating with the guiding channel of the corresponding side face. A metallic shielding has a first side face, a second side face, a front face, and a top face for respectively attaching to the first side face, the second side face, the front face, and the top face of the housing. Two rear tabs respectively extend from the first side face and the second side face of the shielding for engaging within the slots of the rear face of the housing.

DETAILED DESCRIPTION OF THE PREFERRED EMBODIMENT

Figure 1:
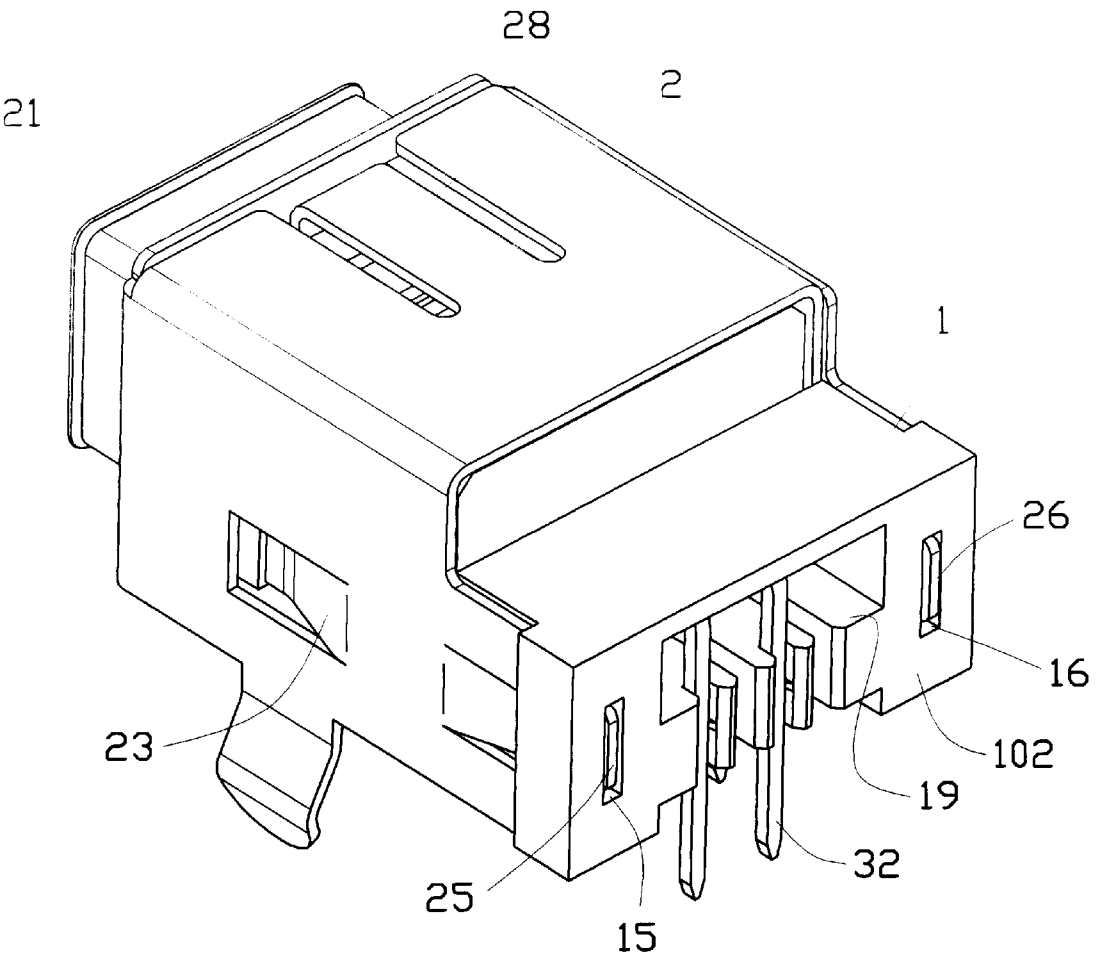
FIG. 1 is a perspective view of an electrical connector in accordance with the present invention.
Figure 2:
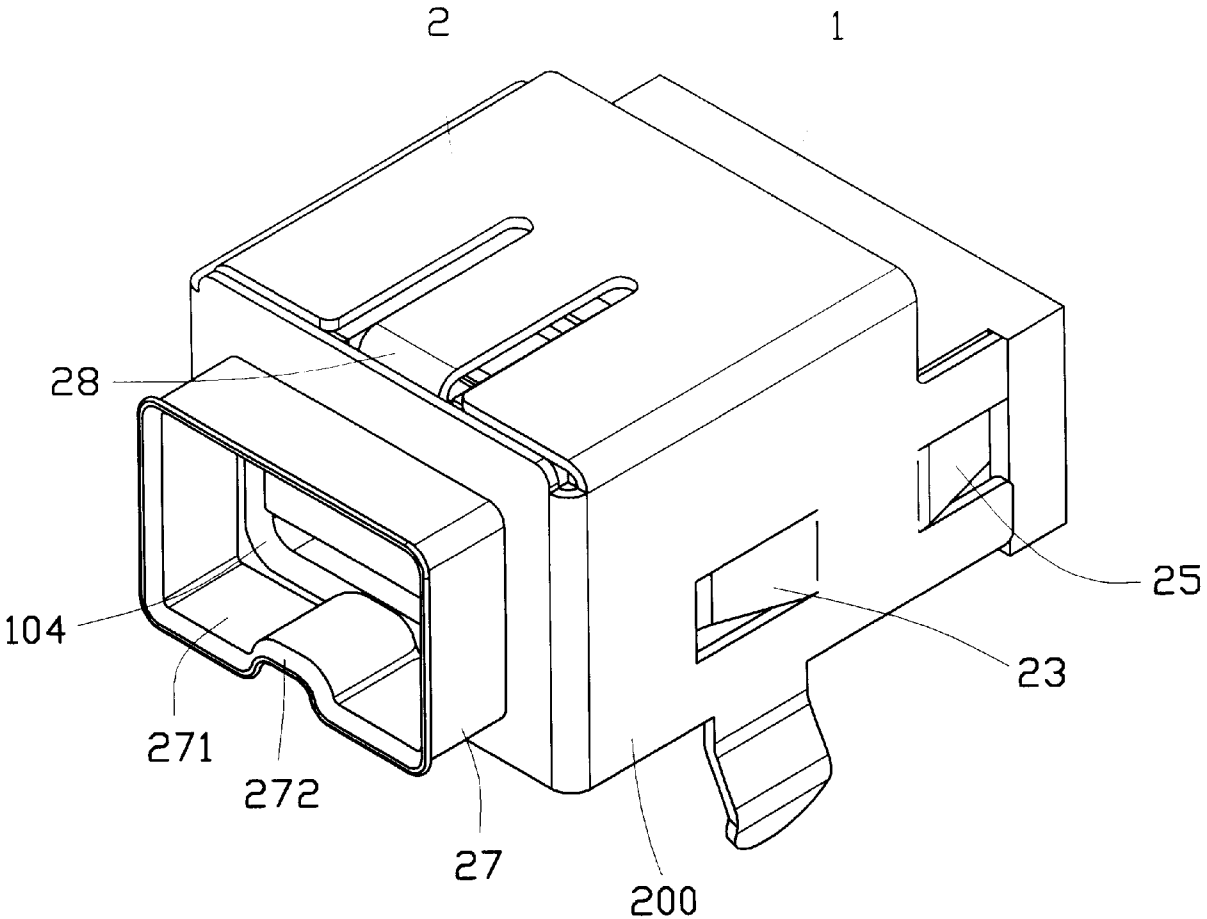
FIG. 2 is another view of FIG. 1.
Figure 3A:
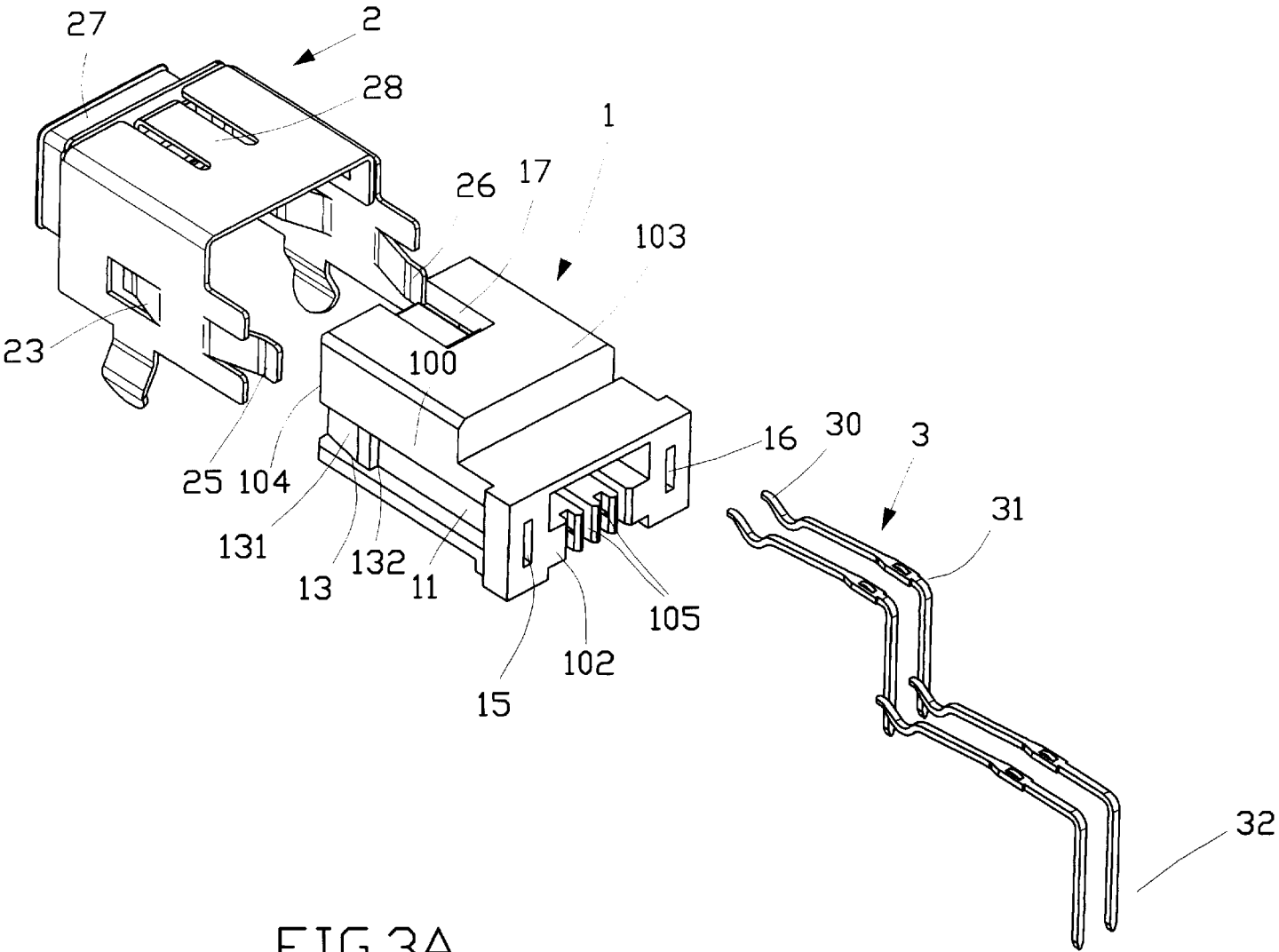
FIG. 3A is an exploded view of the connector of FIG. 1.
Figure 3B:
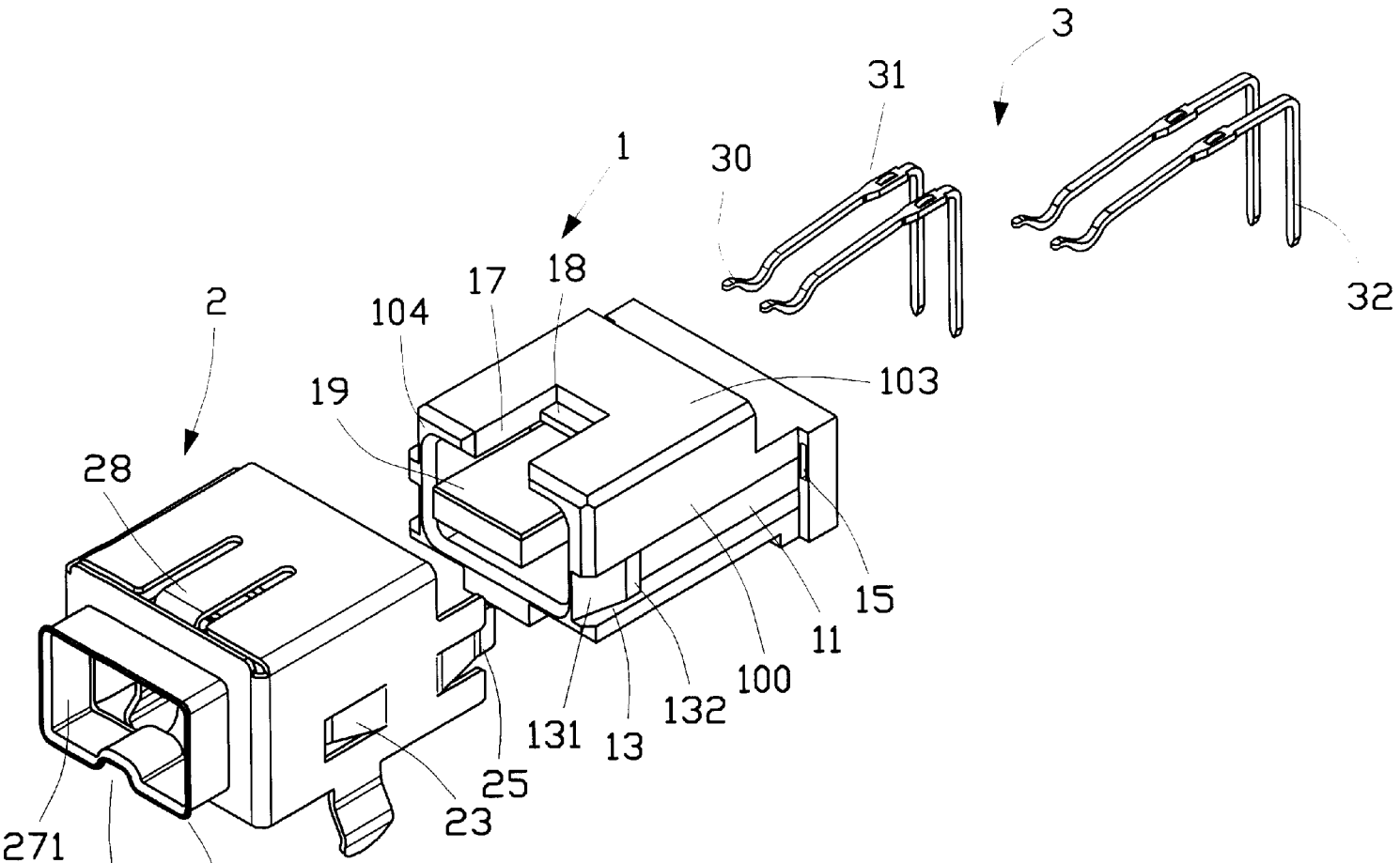
FIG. 3B is another view of FIG. 3A.

Referring to FIGS. 1, 2, 3A, 3B, and 4, an electrical connector in accordance with the present invention comprises an insulative housing 1 for receiving a plurality of contacts 3, and a metallic shielding 2 for enclosing the housing 1. The contact 3 is a right-angled one and has a horizontally extended contacting portion 30, an engaging portion 31 extended from the contacting portion 30, and a soldering portion 32 perpendicular to the engaging portion 31. The housing 1 has a first side face 100, a second side face 101, a front face 104 connected to the side faces 100, 101, a rear face 102 opposite the front face 104 and connected to the side faces 100, 101, and a top face 103 connected to the side faces 100, 101 and the front and rear faces 104, 102, wherein the rear face 102 has two ends respectively extend beyond the side faces 100, 101. An intermediate plate 19 is integrated in the housing 1 for retaining the contacting portions 30 of the contacts 3 in a lower surface thereof. The intermediate plate 19 has a Z-shaped structure (not shown, since it is well known in this field), wherein a vertical portion thereof (not shown) defines four holes (not shown) for interferentially retaining the engaging portions 31 of the contacts 3. First and second guiding channels 11, 12 are respectively defined in lower portions of the first and second side faces 100, 101. First and second tapered protrusions 13, 14 are respectively projected from one end of the guiding channels 11, 12 and each has a guiding face 131, 141 and a stopping edge 132, 142. The rear face 102 defines a first and a second slot 15, 16 respectively in communication with the first and the second channels 11, 12. The top face 103 defines a reception cutout 17 communicating with the front face 104. A ledge 18 is projected from an inner-most wall of the cutout 17. Four recesses 105 are defined in a rear edge of the intermediate plate 19 and the depths thereof are different for adjacent ones but the same for spaced ones for receiving a section of the soldering portions 32 of the contacts 3 in two lines.

Figure 4:
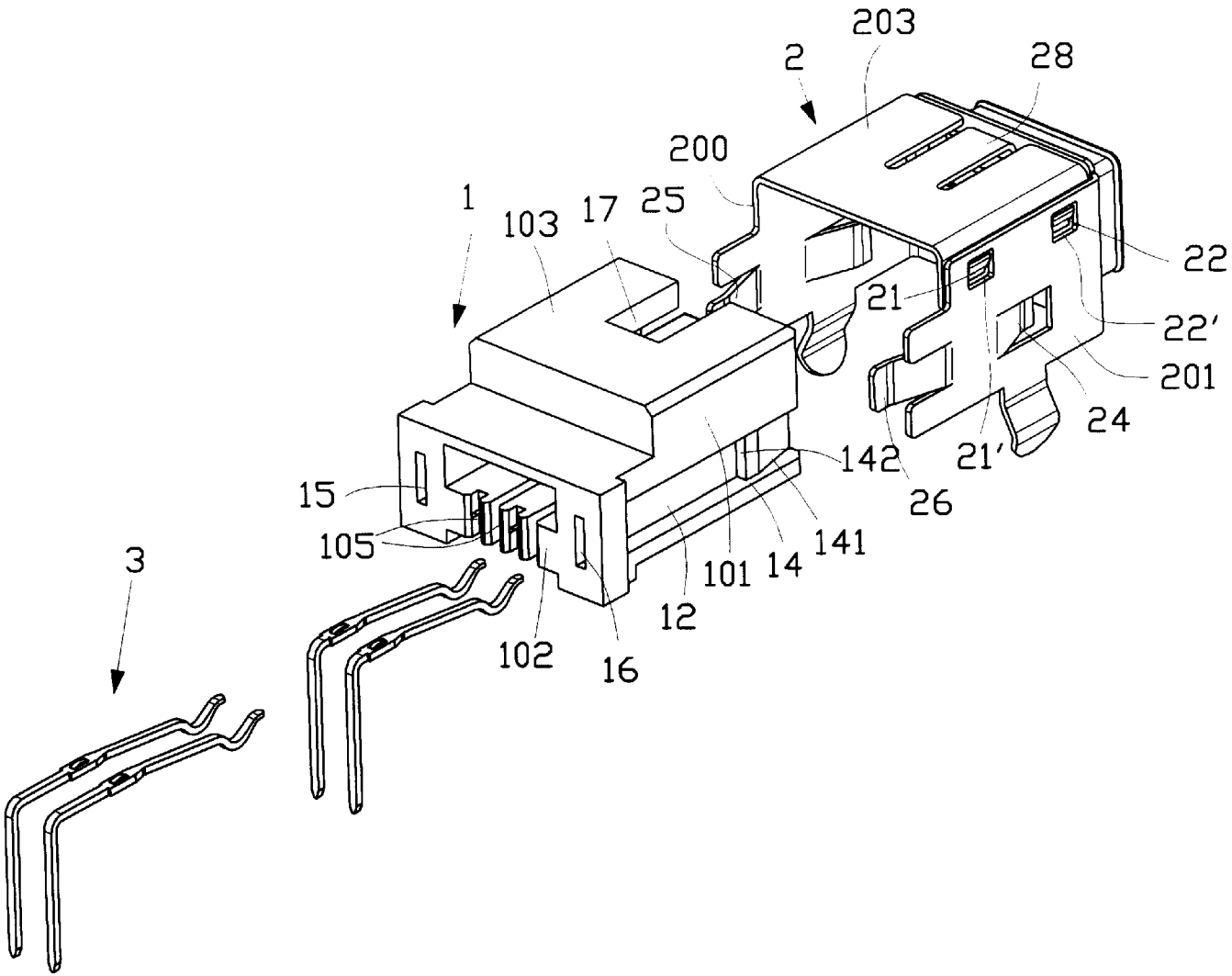
FIG. 4 is further another view of FIG. 3A.
Figure 5:
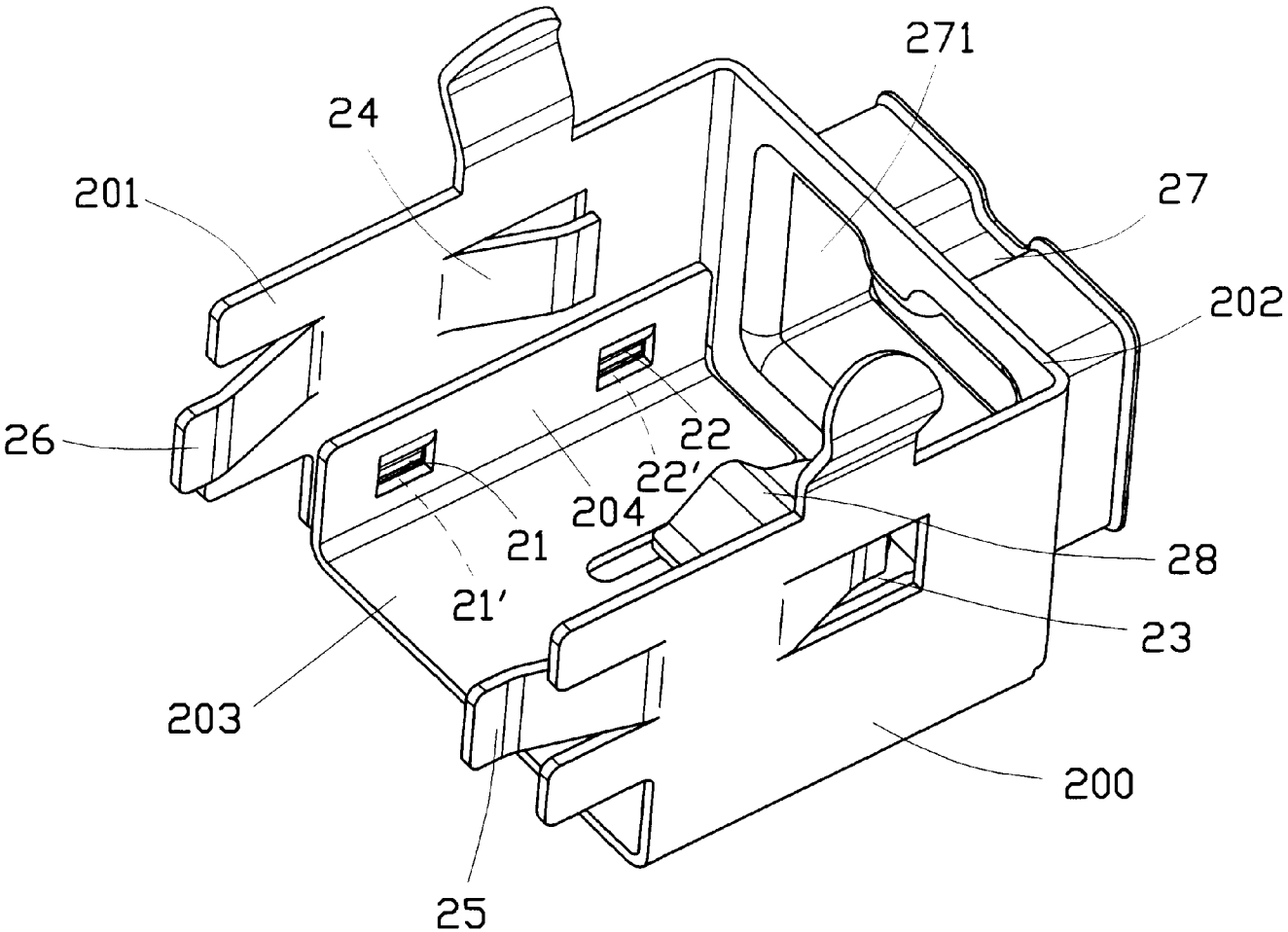
FIG. 5 is a perspective view of the shielding structure of FIG. 1.
Figure 6:
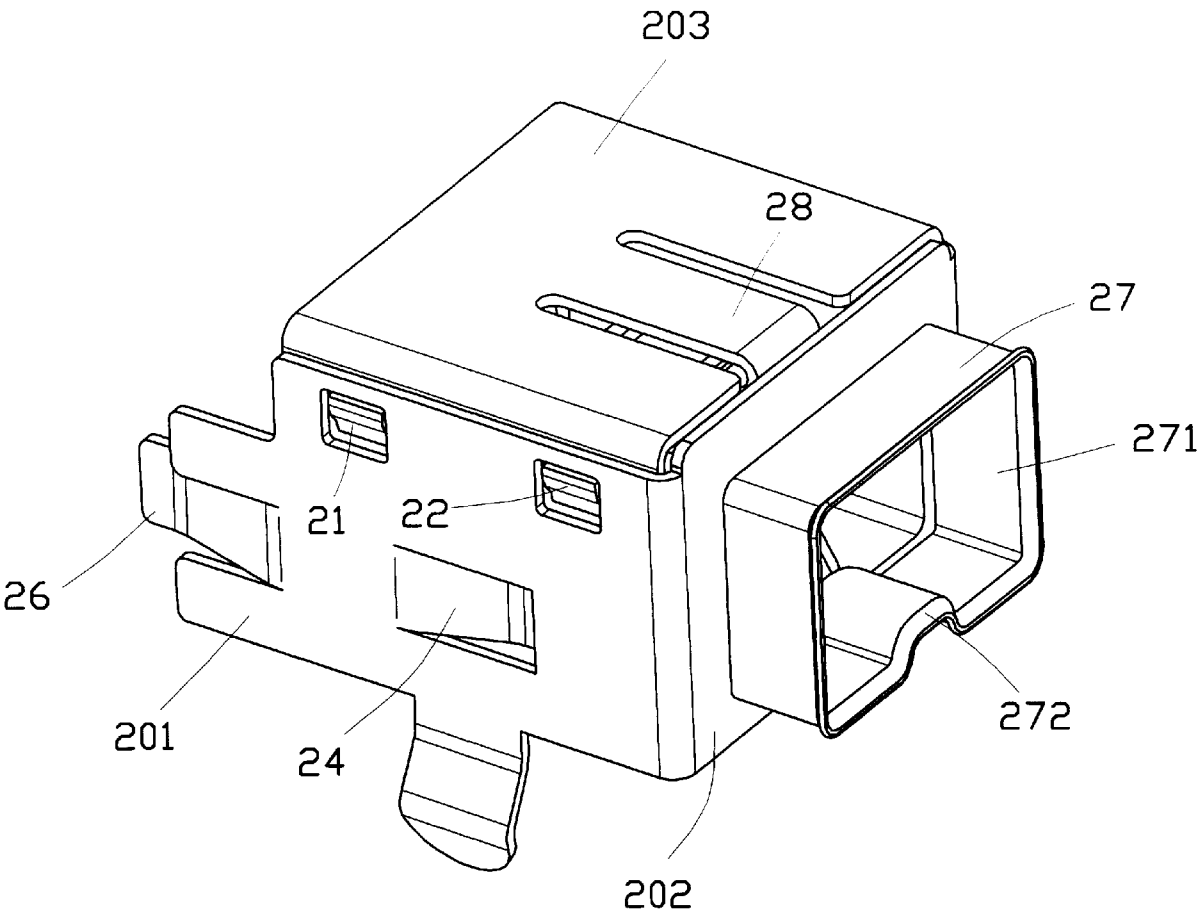
FIG. 6 is another view of the shielding structure of FIG. 5.

Referring to FIGS. 4, 5, and 6, the shielding 2 is formed from a single metallic plate by stamping and bending. The shielding 2 comprises a first side face 200, a second side face 201, a front face 202, and a top face 203. An engaging plate 204 is bent from the top face 203 for engaging with the second side face 201 thereby fixing the shielding like a U-shaped structure and reinforcing the shielding 2. Specifically, the engaging plate 204 has two tabs 21, 22 correspondingly engaging with two holes 21', 22' defined in the second side face 201 and the engaging plate 204 is covered by the second side face 201 after engagement, only a portion of the tabs 21, 22 respectively extending out of the holes 21', 22'.

A hollow frame 27 projects from the front face 202 of the shielding 2 and defines a reception opening 271 in communication with internal space of the housing 1 for noise depression when a complementary connector is inserted therein to. A dimple 272 is formed on a periphery of the hollow frame 27 for prevention of disorientation of insertion of a complementary connector (not shown).

When the shielding 2 is assembled to the housing 1, the first side face 200, the second side face 201, the front face 202, and the top face 203 of the former are respectively attached to the first side face 100, the second side face 101, the front face 104, and the top face 103 of the latter.

Side tabs 23, 24 are respectively formed at the first and second side faces 200, 201 of the shielding 2 and received in the first and second channels 11, 12 of the housing 1 respectively, with an end portions thereof respectively abutting against the stopping edges 132, 142 of the tapered protrusions 13, 14. The side tabs 23, 24 of the shielding 2 slide over the guiding faces 131, 141 when the shielding 2 is originally assembled to the housing 1. Rear tabs 25, 26 respectively extend from the first and second side faces 200, M201 for engaging with the first and second slots 15, 16 of the rear face 102 of the housing 1 after the shielding 2 is fully engaged with the housing 1 (FIG. 1).

Figure 7:
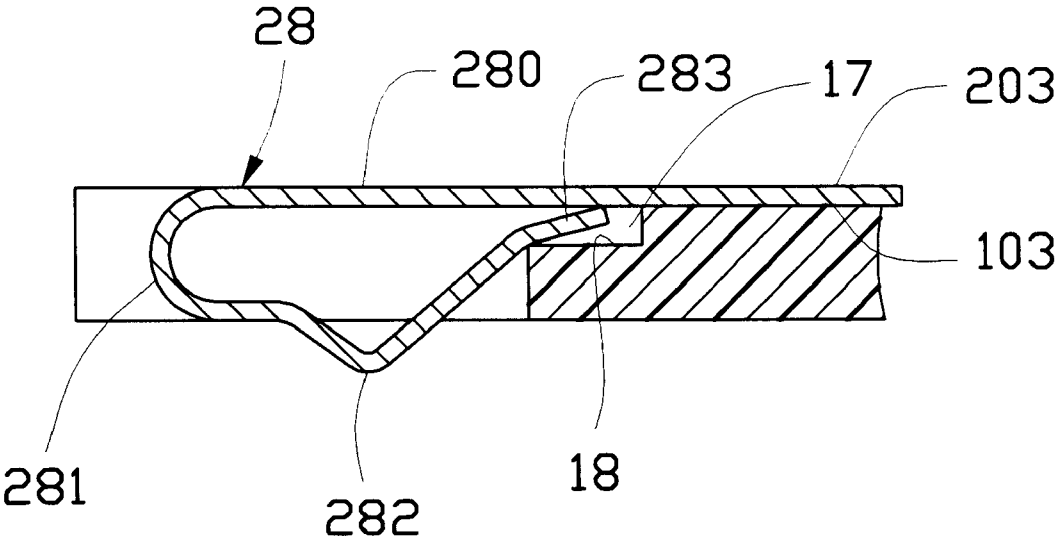
FIG. 7 is a schematic view showing engagement between the shielding structure and the insulative housing of FIG. 3A.

Also referring to FIG. 7, a grounding tab 28 is formed on the top face 203 toward an internal space of the shielding 2 for engaging with the ledge 18 of the housing 1. Specifically, the grounding tab 28 comprises a flat portion 280 substantially coplanar with the top face 203 of the shielding 2, a first curved portion 281 curvedly extending from the flat portion 280, a second curved portion 282 continuing from the first curved portion 281 and formed as a V-shaped structure, and an engaging portion 283 extending from the second curved portion 282 for engaging between the flat portion 280 and the ledge 18 of the housing 1 when the shielding 2 is assembled to the housing 1. With this grounding tab 28, when the connector of the present invention is mated with a complementary connector (not shown), the grounding tab 28 thereof will be forced to contact with a metallic shielding of the complementary connector thereby increasing grounding area for the two connectors.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

What is claimed is:

1. An electrical connector comprising:

an insulative housing having a first side face defining a first guiding channel therein along a longitudinal direction thereof, a second side face defining a second guiding channel therein along a longitudinal direction thereof, a front face connected to the first side face and the second side face, a rear face opposite the front face and connected to the first side face and the second side face, and a top face connected to the first side face, the second side face, the front face, and the rear face, the rear face having two ends respectively extending beyond the first side face and the second side face and each end defining a slot therein communicating with the guiding channel of the corresponding side face;

a metallic shielding having a first side face, a second side face, a front face, and a top face for respectively attaching to the first side face, the second side face, the front face, and the top face of the housing; and two rear tabs respectively extending from the first side face and the second side face of the shielding for extending into and engaging with the slots of the rear face of the housing.

2. The electrical connector as claimed in claim 1, wherein each channel of first side face and second side face of the housing has a tapered protrusion formed at one end thereof near the front face of the housing.

3. The electrical connector as claimed in claim 2, wherein each of the tapered protrusions has a guiding face and a stopping edge.

4. The electrical connector as claimed in claim 3, wherein the shielding has a side tab formed in each of the first side face and the second side face for sliding over the guiding face of the corresponding tapered protrusion during assembly of the shielding and the housing and finally abutting against the stopping edge of the tapered protrusion.

5. The electrical connector as claimed in claim 4, wherein the housing defines a cutout in communication with the front face of the housing.

6. The electrical connector as claimed in claim 5 further comprising a ledge projecting from an inner-most wall of the cutout.

7. The electrical connector as claimed in claim 6, wherein the shielding has a grounding tab formed in the top face thereof for engaging with the ledge of the housing when the shielding is assembled to the housing and for increasing grounding area when the electrical connector is engaged with a complementary connector.

8. The electrical connector as claimed in claim 7, wherein the grounding tab has a flat portion substantially coplanar to the top face of the housing, a first curved portion extending from the flat portion toward an inner space of the shielding, and a second curved portion extending from the first curved portion for engaging between the flat portion and the ledge of the housing when the shielding is assembled to the housing.

9. The electrical connector as claimed in claim 8, wherein the shielding has a hollow frame extending from the front face thereof and an opening thereof is in communication with internal of the housing, the hollow frame having a dimple formed at a periphery thereof for prevention of disorientation when a complementary connector is engaged with the electrical connector.

10. The electrical connector as claimed in claim 9 further comprising an engaging plate extending downward from the top face of the shielding for engaging with the second side face thereof to reinforce the shielding.

11. The electrical connector as claimed in claim 10, wherein the engaging plate has two tabs correspondingly engaging with two holes defined in the second side face.

12. An electrical connector comprising:

an insulative housing having first and second side faces, a front face and a rear face opposite to said front face, said front face and said rear face respectively connected to both the first and second side faces, a top face defining a cutout therein close to the front face;

a metallic shielding defining a first side surface, a second side surface, a front surface and a top surface wherein said front surface and said top surface are not directly integrally connected to each other and a grounding tab extends from one of said front surface and said top surface and into said cutout of the top face of the housing.

13. The connector as claimed in claim 12, wherein said grounding tab is integrally formed around a front edge of the top surface and extends rearward thereof.

14. A metallic shielding defining a first side face and a second side face respectively integrally connected to and extending rearward from two sides of a front face, said front face defining a hollow frame extending forwardly therefrom, a top face integrally extending from only one of said first side and second side faces on one side thereof while being fastened to the other of said first side and second side faces on the other side thereof, a grounding tab integrally extending rearward from a front edge of the top face.

15. The shield as claimed in claim 14, wherein each of said first side face and said second side face further includes a rear tab extending rearward from a rear edge thereof.

* * * * *